United States Patent [19]

Warden et al.

[11] Patent Number: 4,761,026

[45] Date of Patent: Aug. 2, 1988

[54] BALL RETRIEVER

[76] Inventors: Roland R. Warden, 301 S. Evergreen, Wichita, Kans. 67209; Douglas R. Warden, 2221 Farmstead, Wichita, Kans. 67220

[21] Appl. No.: 98,383

[22] Filed: Sep. 18, 1987

[51] Int. Cl.[4] ..... A63B 47/02

[52] U.S. Cl. ..... 294/19.2; 56/328.1; 414/440

[58] Field of Search ..... 294/19.2; 56/328 R, 56/332, 400.02, 400.03, 400.19; 171/58; 414/437, 439, 440

[56] References Cited

U.S. PATENT DOCUMENTS

| | | | |
|---|---|---|---|
| 3,306,480 | 2/1967 | Wysong | 414/440 |
| 3,744,225 | 7/1973 | Reeves | 56/328 R |
| 3,788,506 | 1/1974 | Lee | 414/440 |
| 3,995,759 | 12/1976 | Hollrock et al. | 414/440 |
| 4,066,179 | 1/1978 | Livingston | 414/440 |
| 4,318,654 | 3/1982 | Lee | 294/19.2 X |
| 4,593,519 | 6/1986 | Kimball | 414/440 X |
| 4,645,254 | 2/1987 | Warden | 294/19.2 |

*Primary Examiner*—Johnny D. Cherry

*Attorney, Agent, or Firm*—Kokjer, Kircher, Bradley, Wharton, Bowman & Johnson

[57] ABSTRACT

A portable golf ball retrieving device having parallel disks between which golf balls are picked up. The disks are provided with sets of flat bars which are outboard of the longitudinal axis of the disks and which extend closely yet slidably through guides to permit axially expansion and collapse of the disks. In the collapsed condition, the device is compact for convenient storage. A detent holds the disks in the expanded condition to enhance the stability of the device as it is rolled in a water hazard or along another surface to pick up golf balls.

20 Claims, 1 Drawing Sheet

BALL RETRIEVER

BACKGROUND AND SUMMARY OF THE INVENTION

This invention relates generally to a hand held ball retriever for retrieving golf balls and deals more particularly with a ball retriever which can be collapsed for easy carrying in a golf bag.

U.S. Pat. No. 4,645,254 to Warden discloses a golf ball retriever which is effective in picking up golf balls and which may be easily carried in a golf bag because its construction permits it to be collapsed into a compact condition when not in use. Although this device is generally satisfactory, it can be improved upon in some respects. For example, the disks which pick up golf balls between them are connected only at their centers by a telescoping shaft. As a result of this center connection, the peripheral areas of the disks can wobble somewhat, and this lack of rigidity detracts from the ability of the device to pick up balls and securely grip them between adjacent disks. A related problem is that the gripping action provided by the ridges on the disks is lacking somewhat in power, particularly when the disks wobble. Moreover, because of the telescoping shaft construction, the device cannot be collapsed to as compact a condition as is possible, and this limits its ability to fit easily into the pockets of a golf bag.

The present invention is aimed at overcoming these shortcomings of the patented device and has, as its principal object, the provision of a golf ball retriever that exhibits considerable rigidity in its expanded condition and yet can be collapsed to a compact storage position. Increased rigidity is provided by using three bars on the disks located outboard of the longitudinal axis of the device. The bars are circumferentially spaced around the disks and prevent wobble or other misalignment of the disks. The bars on the different disks are misaligned with one another to further increase the overall rigidity and stability in the expanded position. The bars are received for axial sliding movement in guide sleeves which prevent relative rotation of the disks and yet allow the disks to slide toward and away from one another longitudinally.

Another feature that enhances the structural integrity of the retrieving device is the use of flat bars which are oriented in planes that extend radially of the disks. As a result of this arrangement, the transverse dimensions of the bars are oriented radially and are able to withstand radially applied forces.

A still further important feature of the invention is the provision of a detent arrangement which holds the device in its expanded condition and yet allows it to be collapsed without difficulty when desired.

Yet another object of the invention is to provide a ball retriever that securely grips golf balls that it encounters. This is achieved in part by the increased rigidity of the device and in part by providing the discs with arcuate grooves in which the golf balls are received.

It is an additional object of the invention to provide a ball retriever which is more compact when collapsed than other known devices. In this regard, the offset or staggered arrangement of the bars permits them to overlap one another in the collapsed condition, in contrast to the end to end arrangement of the opposing telescoping shaft sections in the device shown in U.S. Pat. No. 4,645,254. Due to its more compact condition, the device may be stored more easily in a golf bag or elsewhere when not in use, and its overall practical appeal is enhanced accordingly.

Other and further objects of the invention, together with the features of novelty appurtenant thereto, will appear in the course of the following description.

DESCRIPTION OF THE DRAWING

In the accompanying drawing which forms a part of the specification and is to be read in conjunction therewith and in which like reference numerals are used to indicate like parts in the various views.

DETAILED DESCRIPTION OF THE INVENTION

Figures 1, 2, 3, 4, 5, 6:
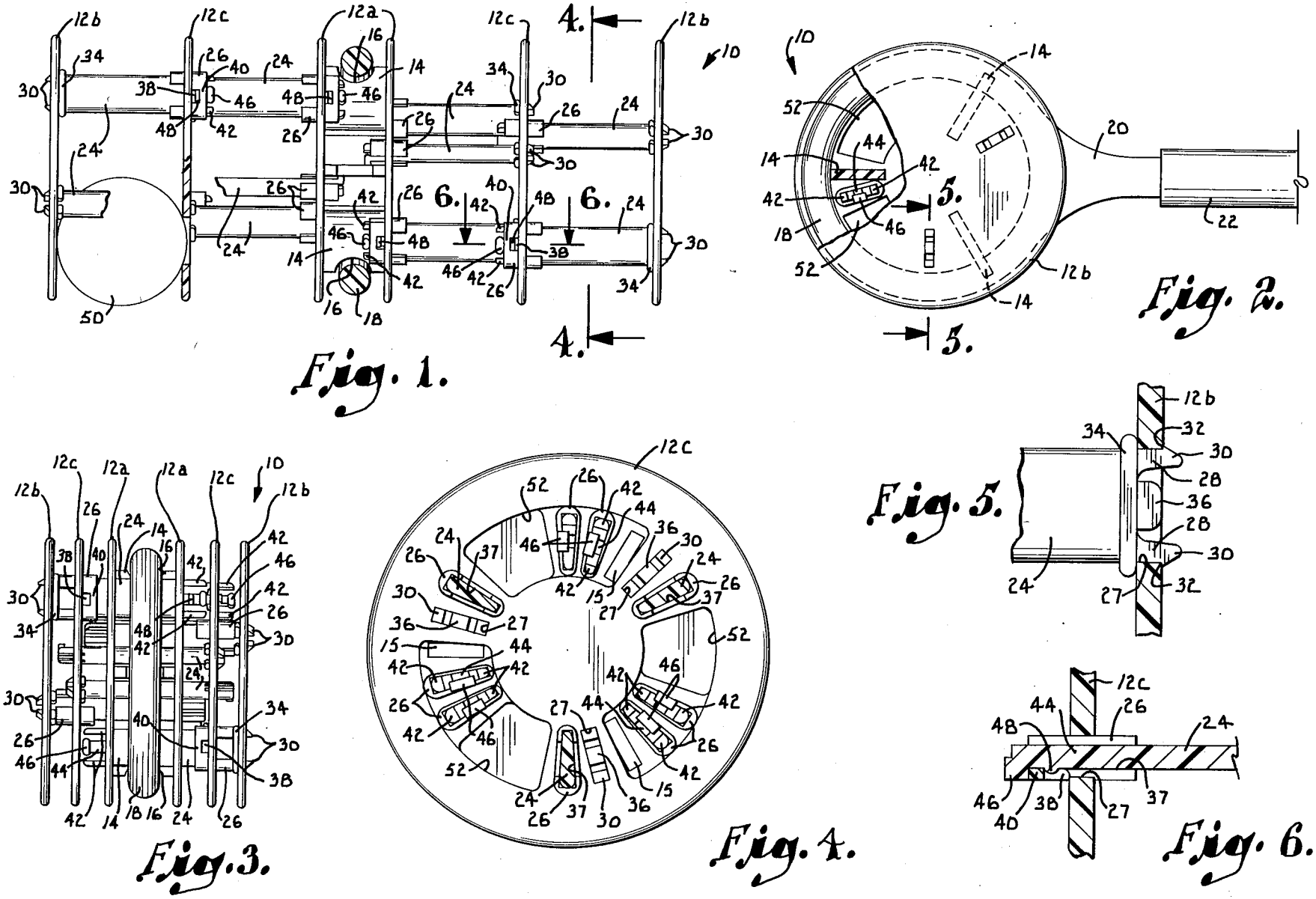
FIG. 1 is a front elevational view of a golf ball retrieving device constructed according to a preferred embodiment of the present invention and disposed in its expanded condition, with portions shown in section and other portions broken away for illustrative purposes.
FIG. 2 is an end elevational view of the ball retrieving device, with a portion broken away for illustrative purposes.
FIG. 3 is a front elevational view similar to FIG. 1, but showing the device in its collapsed storage condition.
FIG. 4 is a sectional view on an enlarged scale taken generally along line 4—4 of FIG. 1 in the direction of the arrows.
FIG. 5 is a fragmentary sectional view on an enlarged scale taken generally along line 5—5 of FIG. 2 in the direction of the arrows.
FIG. 6 is a fragmentary sectional view on an enlarged scale taken generally along line 6—6 of FIG. 1 in the direction of the arrows.

Referring now to the drawing in more detail, numeral 10 generally designates a golf ball retrieving device constructed in accordance with a preferred embodiment of the present invention. The ball retriever 10 is provided with six parallel disks, including a pair of center disks **12*a* located near the center of the device, a pair of end disks 12*b* located on opposite ends of the device, and a pair of intermediate disks 12*c*, one of which is located between each pair of disks 12*a* and 12*b***.

The two center disks **12*a* are rigidly connected with one another by three spacer plates 14. Each plate 14 is provided with tongues 15 (FIG. 4) on its opposite edges which are fitted in slots in discs 12*a* and glued to the disks 12*a*. The spacer plates 14 are equally spaced circumferentially around disks 12*a*, and each spacer plate is contained in a plane which is oriented radially of disks 12*a* and contains the longitudinal axis of the device which extends through the center of each disk 12*a*–12*c*. Plates 14 are outboard of the longitudinal axis of the device. A semi-circular recess 16 is formed in the outer edge of each plate 14, and a circular collar or ring 18 is fitted loosely in the three recesses 16. A neck 20 which extends from ring 18 is attached to an elongate handle 22 which may have a telescoping construction of the type shown in U.S. Pat. No. 4,645,254 to Roland R. Warden. Alternatively, the handle 22 and/or ring 18 may be made detachable from the rest of the device. The relatively loose fit of ring 18 in recesses 16 permits the disks 12*a*–12*c* to rotate relative to ring 18 so that handle 22** can be held in the hand and the disks can be rolled along a surface with the disks rotating about their center longitudinal axis.

Disks 12b and 12c are connected to one another and to the center disks 12a in a manner that prevents the disks from rotating relative to one another but permits the disks to slide longitudinally between the expanded condition shown in FIG. 1 and the collapsed condition shown in FIG. 3. This special connection is provided by a plurality of flat bars 24 and an equal number of guides 26 through which the bars 24 extend. There are four different sets of bars 24 in the device, with two sets of bars extending inwardly from the two end disks 12b and the other two sets extending inwardly from the two intermediate disks 12c. Each set includes three of the bars 24 which are equally spaced circumferentially around the disks from which they extend. The bars 24 are all located outboard of the longitudinal axis of the device, and each bar is flat and is oriented with its transverse dimension located in a plane which extends radially of the disks (See FIG. 4 in particular). Consequently, forces which are applied radially to the device are applied along the relatively strong transverse dimensions of the bar, and the bars are thus able to withstand such radially applied forces.

The manner in which one end of each bar 24 is connected with one of the disks 12b or 12c is best illustrated in FIG. 5. Each disk 12b and 12c is provided with a slot 27 for each bar, and the adjacent end of bar 24 is provided with a pair of spaced apart prongs 28 which are fitted closely through the slot 27. Each prong 28 has a hook like head 30 on its end, and the heads 30 provide shoulders 32 which engage in a snap fit with the outer surface of the disks 12b or 12c. A rib 34 on each bar 24 is located at the bases of the prongs 28 and engages the inside surface of each disk 12b or 12c. The opposing action provided by the shoulders 32 and the ribs 34 secure the bars 24 in extension from the disks with the longitudinal axis of each bar 24 extending parallel to and outboard of the longitudinal axis of the device. Preferably, glue is applied to the prongs 28, shoulders 32 and ribs 34 in order to enhance the security of the connection. A small tab 36 is located on the end of each bar 24 between the two prongs 28 and may be glued to the opposite side edges of the slot 27.

The bars 24 which extend from each disk are axially misaligned with plates 14 and with the bars 24 which extend from the other disks, as best shown in FIG. 4. As a consequence of this misalignment of the bars, the device does not present any areas of weakness because the bars are staggered around the circumference of the device. In addition, the staggered arrangement of the bars provides the device with enhanced beam strength and overall rigidity and stiffness.

The guides 26 are arranged in sets on disks 12a and 12c, and each set of guides includes three guides 26 which receive the three bars in the corresponding set of bars. Thus, the guides 26 which are mounted on disks 12c receive the bars 24 which extend from the end disks 12b, and the guides which are mounted on the center disks 12a receive the bars which extend from the intermediate disks 12c. The guides 26 are equally spaced circumferentially on disks 12a and 12c in order to match the circumferential spacing of the bars 24. The guides 26 in each set are out of alignment with the guides in the other sets in the same manner described for bars 24.

Each guide 26 takes the form of a sleeve which is flattened in order to snugly receive the flat bar 24 which extends through it. Each guide presents a guide opening 37 (See FIGS. 4 and 6) through which the corresponding bar 24 closely extends. Guides 26 are fitted through slots formed in disks 12a and 12c and are glued to the disks which carry them, as best shown in FIG. 6.

With continued reference to FIG. 6, each guide 26 is provided on one face with an opening 38 located adjacent to the disk 12a or 12c which carries the guide. A thin strip 40 extends across each guide between the opening 38 and the nearest edge of the guide. The end of each bar 24 opposite the end which is connected with one of the disks 12b or 12c is provided with a pair of projecting fingers 42 on the opposite side edges of the bar and a central finger 44 located between the two fingers 42 (See FIG. 3). The tip of each finger 44 carries a projecting lug 46 which forms a stop that prevents bar 24 from passing completely through the guide 26. Each finger 44 also presents a small button 48 which projects from the finger and is small enough to enter opening 38 in the fully extended position of the device, as best shown in FIG. 6. In the fully extended condition, lug 46 engages strip 40 to act as a stop, while the button 48 fits closely in opening 38 to provide a detent which releaseably maintains the bar 24 in the fully extended position. Button 48 can be dislodged from opening 38 and moved past the strip 40 in order to release the detent and permit the device to be collapsed to the compact position shown in FIG. 3.

As previously indicated, each bar 24 fits closely yet slidably in one of the guides 26. The close fit of the bars in the guides prevents the disks 12a–12c from rotating relative to one another, while the sliding fit of the bars in the guides permits the disks to move axially toward and away from one another between the expanded position of the device shown in FIG. 1 and the collapsed condition shown in FIG. 3. In the expanded condition, the disks are spaced apart a distance slightly less than the diameter of a golf ball 50. In the collapsed position, disks 12b and 12c slide inwardly toward the center disks 12a, with the sliding fit of bars 24 and guides 26 allowing the device to collapse. The staggered arrangement of bars 24 allows the bars to extend side by side and overlap one another in the collapsed condition. In addition, each disk 12a and 12c is provided with an arcuate slot 52 which receives the bars which extend from other disks in the collapsed condition. Each slot 52 extends through an arc somewhat less than 120°, and the slots in the different disks are circumferentially offset or staggered. Collapsing movement of disks 12b and 12c is limited by engagement between the ends of the guides 26 and the ribs 34.

In use, device 10 is expanded to the position shown in FIG. 1, and handle 22 can then be used to roll the disks 12a–12c along the bottom of a water hazard or other relative inaccessible surface on which a golf ball rests. When a golf ball is encountered by the device 10, it fits between two of the disks and is gripped therebetween as the disks continue to roll and thus lift the ball off of the surface. Once the golf ball has been picked up in this manner, it can be lifted out of the hazard simply by lifting the device 10.

The disks 12a–12c are resilient enough to permit entry of a golf ball 50 between them and withdrawal of the golf ball from between the disks after it has been removed from the hazard. It is also noted that the golf ball fits partially in at least one of the arcuate slots 52 when it is picked up between two of the disks, and the fit of the ball in the slot enhances the gripping power of the device and prevents the ball from inadvertently becoming dislodged from between the disks.

When the device is not in use, it can be stored in the pocket of a golf bag or elsewhere by retracting it to the collapsed position shown in FIG. 3. Because of the side by side location of bars 24 in the collapsed condition, the device 10 is arranged in a particularly compact manner and is thus more easily stored than devices which are longer when collapsed.

In addition to the enhanced gripping action and more compact arrangement, device 10 is more rigid and stable than other known devices. The rigidity is due in large part to the provision of three bars 24 extending between each pair of disks at circumferentially spaced locations outboard of the central longitudinal axis of the device. The connection of adjacent disks at three offset points provides stability against wobbling motion of the disks, while the orientation of the flat bars in radial planes adds to the rigidity and strength. The overall result is that the device 10 exhibits increased rigidity and stability, enhanced structural strength, enhanced gripping power for holding golf balls, and a more compact arrangement than has been achieved with other known devices. Although six disks normally suffice, the device can be provided with a greater or lesser number of disks if desired.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. A device for retrieving golf balls, comprising:

a plurality of disks;

means for connecting said disks in a manner permitting the disks to slide toward and away from one another along a longitudinal axis centered on the disks between an expanded condition wherein adjacent disks are spaced apart sufficiently to receive and grip a golf ball therebetween and a collapsed condition wherein the spacing between the disks is reduced;

said connecting means comprising a plurality of rigid bars each connected at one end to one of said disks and each extending parallel to and outboard of said longitudinal axis;

said connecting means further comprising means for establishing a sliding connection between each bar and disks other than the one disk to which the bar is connected to thereby permit the disks to slide longitudinally along the bars between the expanded and collapsed conditions;

a handle; and means for coupling said handle with said disks in a manner permitting the disks to rotate relative to the handle so that the disks can roll on a surface in the expanded condition to pick up golf balls between adjacent disks.

2. The device of claim 1, wherein said means for establishing a sliding connection comprises a plurality of guides mounted on the disks and each presenting a guide opening through which a corresponding bar closely extends in a manner preventing relative rotation of the disks but accommodating longitudinal movement between the expanded and collapsed conditions.

3. The device of claim 2, including an end of each bar opposite said one end thereto providing a stop engageable with the corresponding guide to prevent said opposite end of the bar from passing through the guide opening.

4. The device of claim 2, wherein:

said bars are arranged in a plurality of sets each including a plurality of bars, each set of bars extending from a different one of the disks; and the bars in each set are axially misaligned with the bars in the other sets.

5. The device of claim 1, wherein:

said bars are arranged in a plurality of sets each including a plurality of bars, each set of bars extending from a different one of the disks; and the bars in each set are axially misaligned with the bars in the other sets.

6. The device of claim 5, wherein each set of bars comprises three bars equally spaced circumferentially on the disks from which they extend.

7. The device of claim 6, including three arcuate slots in some of said disks for receiving the bars which extend from other of the disks in the collapsed condition of the disks, each slot being located to receive a ball gripped between adjacent disks.

8. The device of claim 1, including detent means for maintaining said disks in the extended condition.

9. The device of claim 1, wherein:

each of said bars is a flat bar member having opposite side edges defining a transverse dimension thereof; and each of said bar members is oriented with its transverse dimension contained in a plane extending radially of the disks.

10. A golf ball retrieving device comprising:

a plurality of parallel disks defining a longitudinal axis extending through the center of each disk;

a plurality of sets of bars each including a plurality of bars extending from one of the disks outboard of and parallel to said longitudinal axis;

a set of guides for each set of bars, each set of guides including a plurality of guides mounted on one of the disks with each guide presenting a guide opening through which a corresponding bar extends slidably to permit said disks to slide along said bars toward and away from one another between an extended condition wherein adjacent disks are spaced apart sufficiently to receive and grip golf balls therebetween and a collapsed condition wherein the spacing between adjacent disks is reduced; and a handle coupled with said disks in a manner to permit the disks to roll about said longitudinal axis along a surface from which golf balls may be picked up between adjacent disks.

11. The dev1ce of claim 10, wherein the bars in each set of bars are axially misaligned with the bars in other sets of bars.

12. The device of claim 10, wherein each set of bars includes three bars spaced circumferentially on the disk from which they extend.

13. The device of claim 12, wherein the bars in each set of bars are axially misaligned with the bars in other sets of bars.

14. The device of claim 10, including cooperating detent means on the bars and guides for holding said disks in the expanded condition.

15. The device of claim 10, including a plurality of arcuate slots in some of the disks at locations to receive the bars which extend from other of the disks when the disks are in the collapsed condition.

16. The device of claim 10, including a stop on each bar engaging the corresponding guide in the expanded condition of the disks to prevent detachment of the bar from the guide.

17. The device of claim 10, wherein:

each of said bars is a flat bar member having opposite side edges defining a transverse dimension thereof; and each of said bar members is oriented with its transverse dimension contained in a plane extending radially of the disks.

18. A golf ball retrieving device comprising:

a plurality of parallel disks including a pair of opposite end disks and a pair of rigidly connected center disks;

a plurality of rigid bars extending from each of said disks except the center disks, said bars on adjacent disks being staggered circumferentially and all of the bars being parallel to and outboard of a longitudinal axis extending through the center of each disk;

a plurality of guide openings in each disk except the end disks, said openings being located and arranged to slidably receive the bars extending from the adjacent outer disk in a manner preventing relative rotation of the disks but permitting axial movement of the disks between an expanded condition wherein adjacent disks are spaced apart sufficiently to receive and grip golf balls therebetween and a collapsed condition wherein the outer disks are closer together than in the expanded condition; and a handle coupled between the center disks in a manner allowing the disks to be rolled along a surface to pick up golf balls thereon between adjacent disks.

19. The device of claim 18, including detent means for holding the disks in the expanded condition.

20. The device of claim 18, wherein the bars extending from each disk except the center disks are three in number and the bars extending from the disks are equally spaced circumferentially.

* * * * *